US011937699B2

(12) United States Patent
Scott

(10) Patent No.: US 11,937,699 B2
(45) Date of Patent: Mar. 26, 2024

(54) BED AND FRAME ASSEMBLY

(71) Applicant: Michael Scott, Sacramento, CA (US)

(72) Inventor: Michael Scott, Sacramento, CA (US)

( * ) Notice: Subject to any disclaimer, the term of this patent is extended or adjusted under 35 U.S.C. 154(b) by 350 days.

(21) Appl. No.: 17/404,068

(22) Filed: Aug. 17, 2021

(65) Prior Publication Data

US 2023/0059520 A1 Feb. 23, 2023

(51) Int. Cl.
*A47C 20/04* (2006.01)

(52) U.S. Cl.
CPC ..... *A47C 20/041* (2013.01); *A47C 20/042* (2013.01)

(58) Field of Classification Search
CPC ... A47C 20/041; A47C 20/042; A47C 21/028; A47C 17/86; A61H 1/0222; A61H 1/0292
USPC ..... 5/616
See application file for complete search history.

(56) References Cited

U.S. PATENT DOCUMENTS 2,211,453 A * 8/1940 Buttikofer ..... A47C 20/041 5/616
2,500,742 A * 3/1950 Taylor ..... A47C 20/08 5/616
3,278,952 A * 10/1966 Holm ..... A47C 20/08 5/616
3,510,886 A * 5/1970 Benoit ..... A61G 7/002 5/616
3,840,910 A * 10/1974 Damico ..... A61G 7/015 5/616
4,087,872 A * 5/1978 Smirle ..... A47C 19/045 5/616
4,999,864 A * 3/1991 Crews ..... A47C 19/045 5/9.1
5,020,173 A * 6/1991 Dreyer, Jr. ..... A47C 17/86 297/188.1
5,542,744 A * 8/1996 Bathrick ..... A47C 20/041 74/89.41
5,568,661 A * 10/1996 Bathrick ..... A47C 20/041 5/616
5,579,550 A * 12/1996 Bathrick ..... A47C 19/005 5/618
5,704,249 A * 1/1998 Krauska ..... F16H 25/24 74/89.37
5,937,459 A * 8/1999 Binaghi ..... A47C 20/041 254/102

(Continued)

FOREIGN PATENT DOCUMENTS

WO WO2009126262 10/2009

*Primary Examiner* — Justin C Mikowski
*Assistant Examiner* — Luke Hall

(57) ABSTRACT

A bed and frame assembly includes a box that is positionable on a horizontal support surface. A pair of tracks is each of the tracks is removably disposed on the box. A lid is slidably disposed on the box for supporting a mattress. The lid is positionable in a first position to close the box or a second position to facilitate sheets on the mattress to be changed. A plurality of roller units is each disposed on the lid and rollably engages a respective one of the tracks to facilitate the lid to be rolled between the first position and the second position. A sliding unit is integrated into the box and the sliding unit is in mechanical communication with the lid. The sliding unit is actuatable in a closing condition for sliding the lid into the first position and the sliding unit is actuatable in an opening condition for sliding the lid into the second position.

6 Claims, 5 Drawing Sheets

(56) References Cited

U.S. PATENT DOCUMENTS 6,629,322 B1 * 10/2003 Monroe ..... A47C 17/84 5/118
6,907,625 B2 * 6/2005 Nomura ..... A61G 7/1067 5/81.1 HS
6,941,594 B1 * 9/2005 Mosley ..... A47C 19/045 5/200.1
D521,768 S 5/2006 Black
7,743,440 B2 * 6/2010 Burnett ..... A47C 17/86 5/200.1
8,376,437 B2 * 2/2013 Edens ..... B60J 7/1614 296/26.05
8,555,438 B2 * 10/2013 Turner ..... A61G 7/018 5/616
9,241,577 B1 * 1/2016 Shea ..... B66F 11/042
9,743,776 B2 8/2017 Ray
10,342,358 B1 * 7/2019 Palashewski ..... A61G 7/018
11,684,165 B2 * 6/2023 Daser ..... A61H 1/0292 5/616
2002/0101089 A1 * 8/2002 Brown ..... B60R 11/06 296/37.6
2005/0166318 A1 * 8/2005 Bokser ..... A47C 17/86 5/2.1
2005/0283911 A1 * 12/2005 Roussy ..... A61G 7/012 5/616
2007/0256240 A1 * 11/2007 Regev ..... A47C 17/86 160/368.1
2008/0229502 A1 * 9/2008 Johnson ..... A61G 7/02 5/604
2008/0271246 A1 * 11/2008 Nielsen ..... A47C 20/041 5/616
2011/0094030 A1 * 4/2011 Harrington ..... A47B 81/005 5/503.1
2011/0095559 A1 * 4/2011 Edens ..... B60J 7/1614 296/100.1
2011/0271446 A1 * 11/2011 Shih ..... A47C 20/041 5/174
2012/0159709 A1 * 6/2012 Nguyen ..... A61G 7/1019 5/488
2013/0019402 A1 * 1/2013 Vervoort ..... A47C 17/86 5/412
2013/0291309 A1 * 11/2013 Koorey ..... A47C 31/00 5/658
2015/0135865 A1 * 5/2015 Oberndorfer ..... F16H 25/2025 74/89.14
2015/0171703 A1 * 6/2015 Viberg ..... H02K 7/1166 310/83
2015/0354679 A1 * 12/2015 Oberndörfer ..... A61C 8/0068 74/89.23
2016/0309907 A1 * 10/2016 Shea ..... A47C 21/06
2017/0101035 A1 * 4/2017 Sam ..... B60N 2/2866
2018/0132626 A1 * 5/2018 He ..... A47C 20/041
2018/0220803 A1 * 8/2018 Blueford ..... G08B 25/10
2018/0338625 A1 * 11/2018 Nava ..... A47C 19/021
2019/0021509 A1 * 1/2019 Shan ..... A47C 20/041
2019/0223609 A1 * 7/2019 Sherman ..... A47C 27/14
2020/0022504 A1 * 1/2020 Zhang ..... A47C 20/041
2020/0214461 A1 * 7/2020 Wang ..... A47C 20/08
2020/0221883 A1 * 7/2020 Chen ..... A47C 27/083
2020/0405068 A1 * 12/2020 Oberle, Sr. ..... A61G 7/012
2021/0321784 A1 * 10/2021 Freelend ..... A61G 7/018
2021/0321786 A1 * 10/2021 Scarleski ..... A47C 21/028
2021/0378407 A1 * 12/2021 Fromme-Ruthmann ..... A47C 17/52
2022/0071403 A1 * 3/2022 Schneidewent ..... A47C 17/86
2022/0248864 A1 * 8/2022 Shan ..... A47C 19/122
2022/0304476 A1 * 9/2022 Liu ..... A47C 20/12
2023/0027599 A1 * 1/2023 Fry ..... A47C 19/22
2023/0190005 A1 * 6/2023 Atkinson ..... A47C 19/045 5/11

* cited by examiner

BED AND FRAME ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to bed and frame devices and more particularly pertains to a new bed and frame device for sliding a mattress back and forth to facilitate changing sheets on the mattress. The device includes a box and a lid that is slidably positioned on the box for supporting a mattress. The device includes a sliding unit for sliding the lid back and forth. Additionally, the device includes a jack for urging the lid between an open position or a closed position.

(2) Description of Related Art Including Information Disclosed Under 37 CFR 1.97 and 1.98

The prior art relates to bed and frame devices including a variety of bed frames which includes a lifting mechanism for lifting or lowering a mattress. The prior art discloses a bunk bed device that includes a hinge unit for making a top bunk more accessible for changing sheets on the top bunk. The prior art discloses a bed frame device that includes a sliding mechanism for sliding a mattress laterally on the bed frame. The prior art discloses a bed frame device that includes a rotation unit for rotating a mattress.

BRIEF SUMMARY OF THE INVENTION

An embodiment of the disclosure meets the needs presented above by generally comprising a box that is positionable on a horizontal support surface. A pair of tracks is each of the tracks is removably disposed on the box. A lid is slidably disposed on the box for supporting a mattress. The lid is positionable in a first position to close the box or a second position to facilitate sheets on the mattress to be changed. A plurality of roller units is each disposed on the lid and rollably engages a respective one of the tracks to facilitate the lid to be rolled between the first position and the second position. A sliding unit is integrated into the box and the sliding unit is in mechanical communication with the lid. The sliding unit is actuatable in a closing condition for sliding the lid into the first position and the sliding unit is actuatable in an opening condition for sliding the lid into the second position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
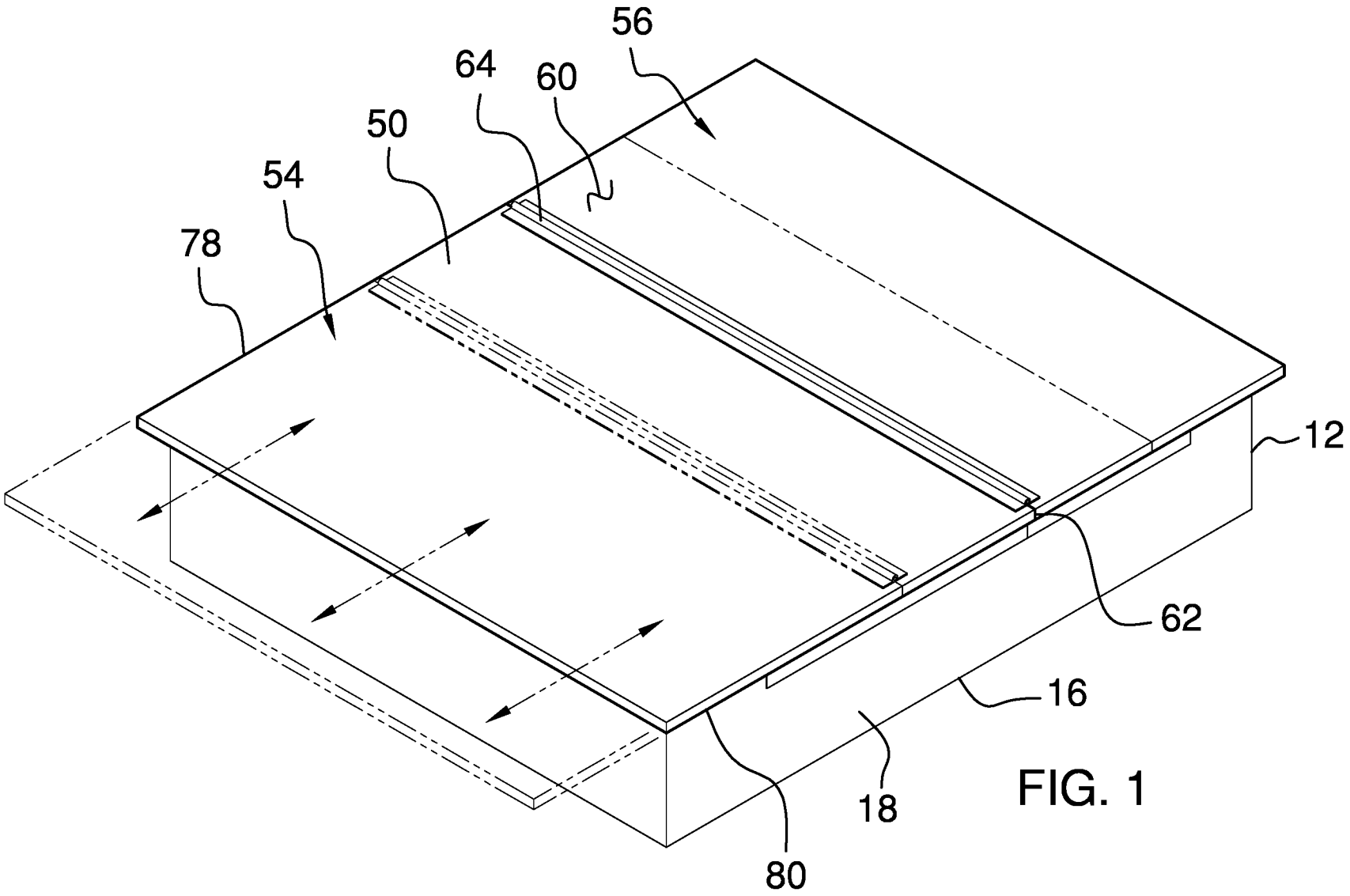
FIG. 1 is a top perspective view of a bed and frame assembly according to an embodiment of the disclosure.
Figure 2:
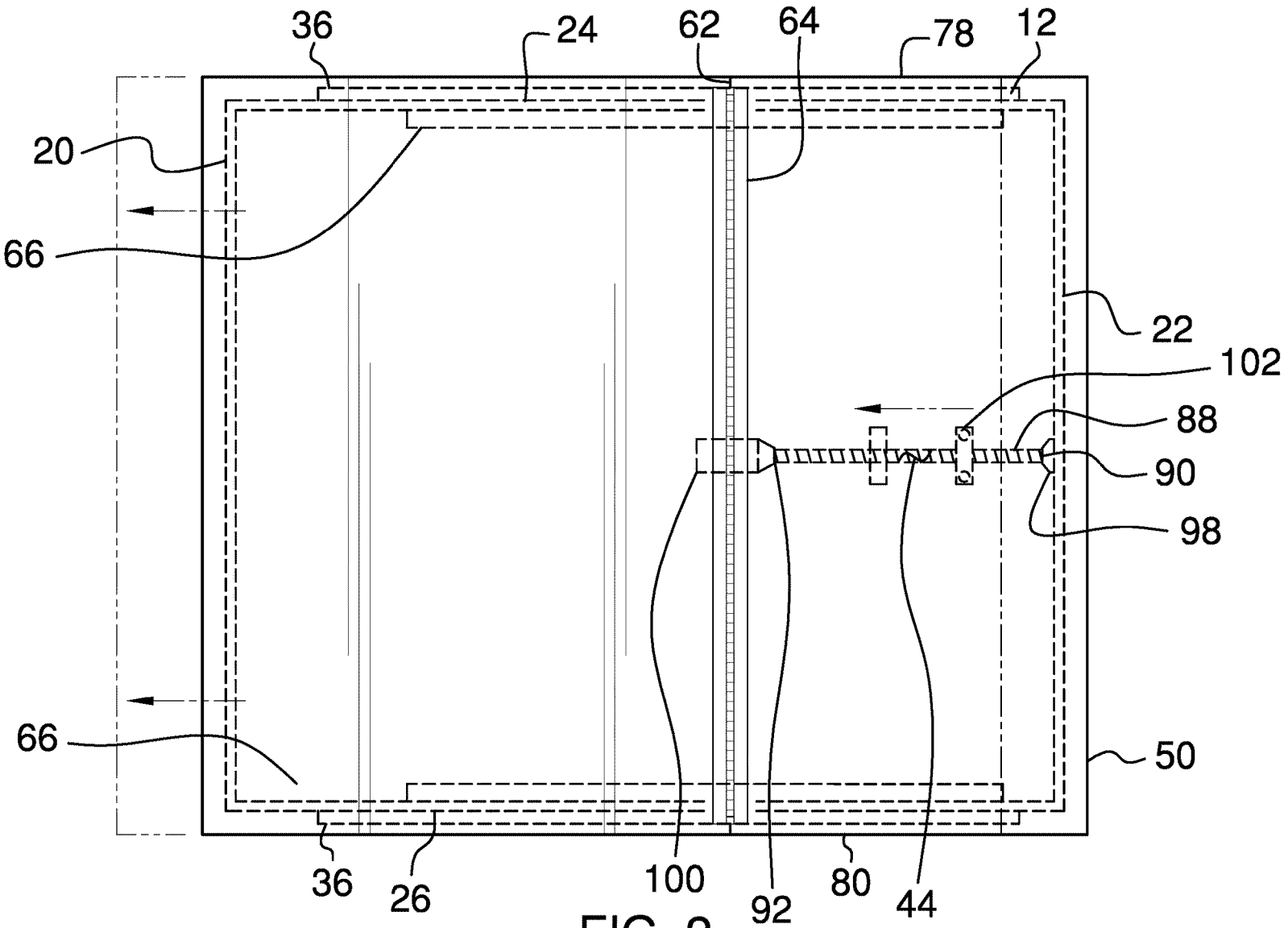
FIG. 2 is a top phantom view of an embodiment of the disclosure.
Figure 3:
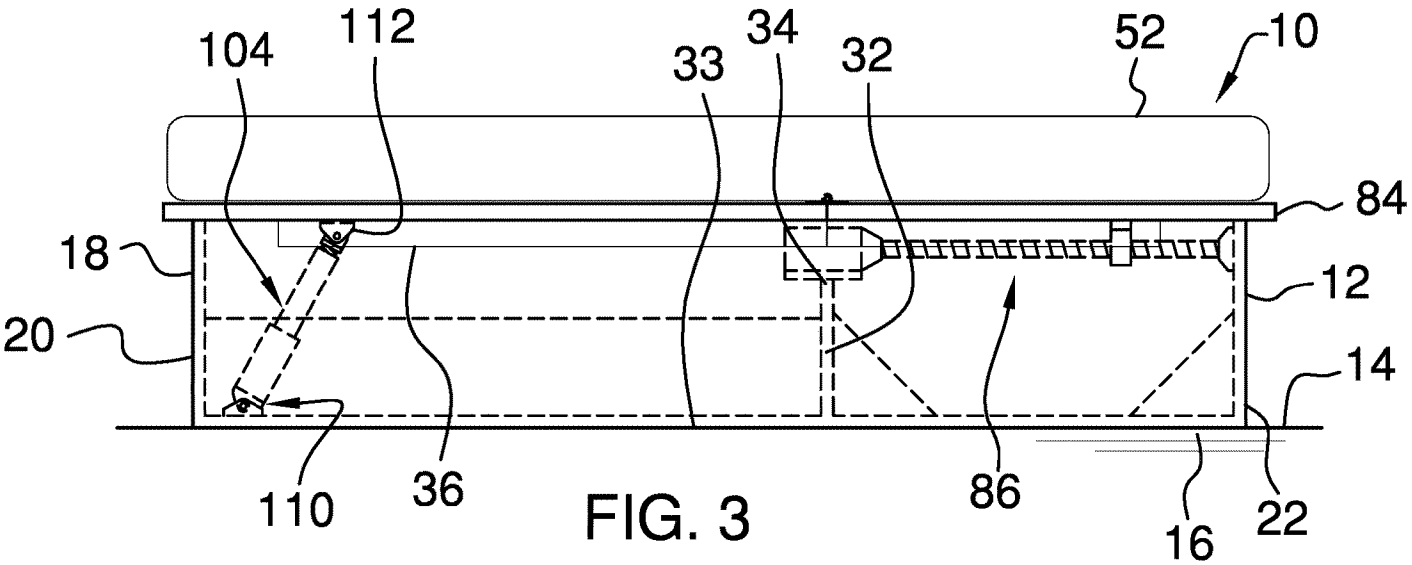
FIG. 3 is a right side phantom view of an embodiment of the disclosure showing a lid in a first position.
Figure 4:
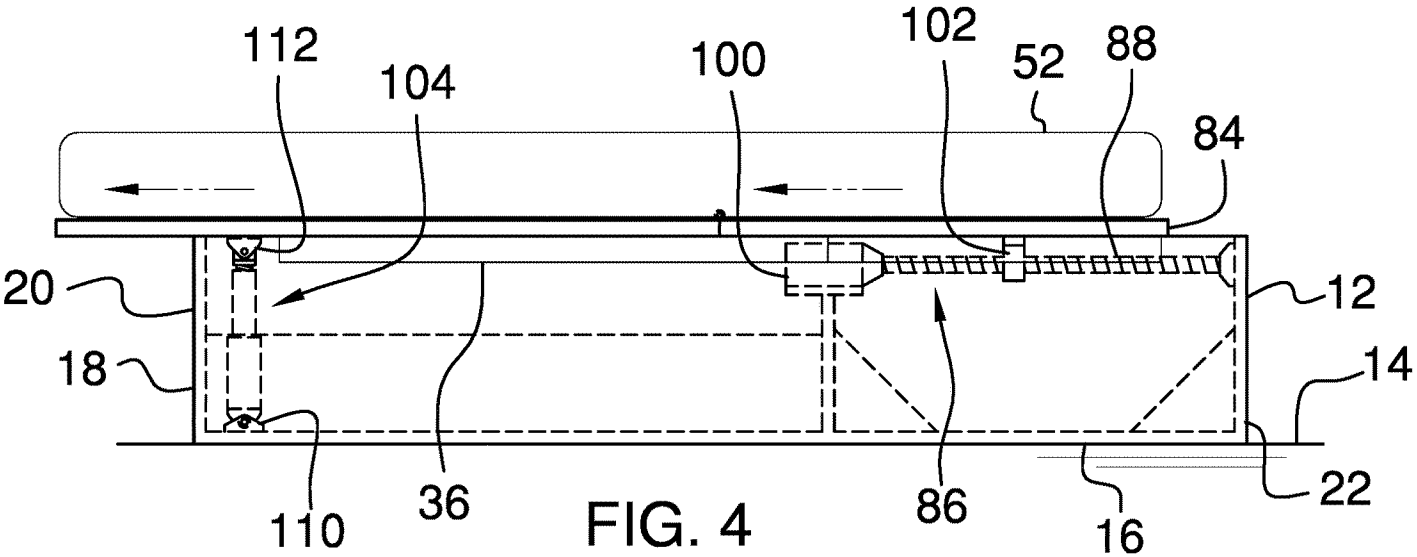
FIG. 4 is a right side phantom view of an embodiment of the disclosure showing a lid in a second position.
Figure 5:
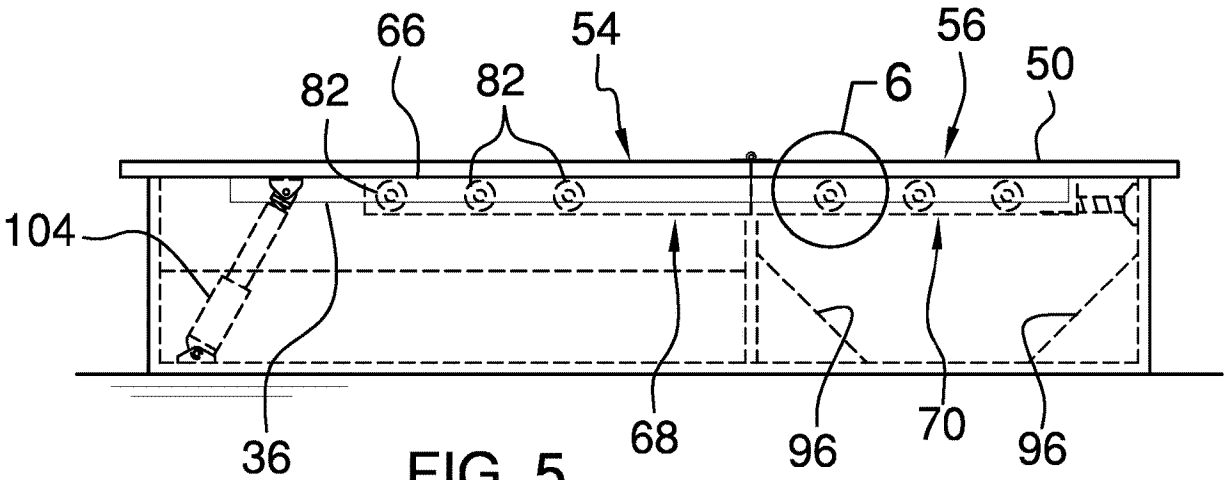
FIG. 5 is a right side phantom view of an embodiment of the disclosure.
Figure 6:
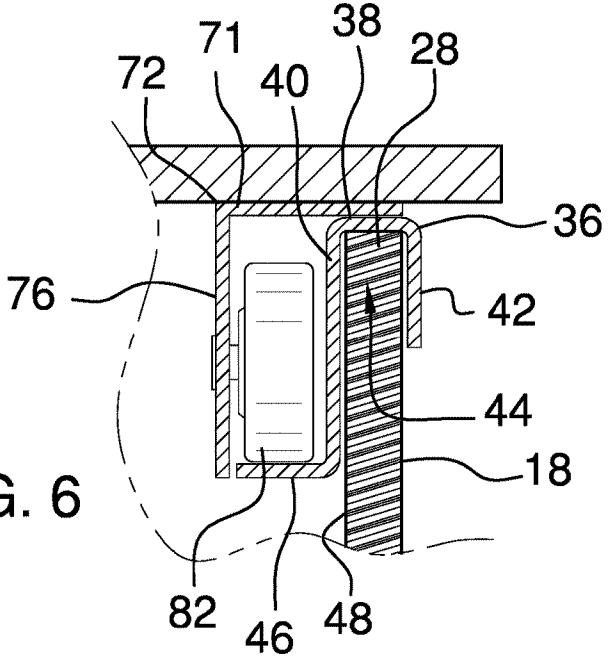
FIG. 6 is a detail view of an embodiment of the disclosure taken from circle 6 of FIG. 5 of an embodiment of the disclosure.
Figure 7:
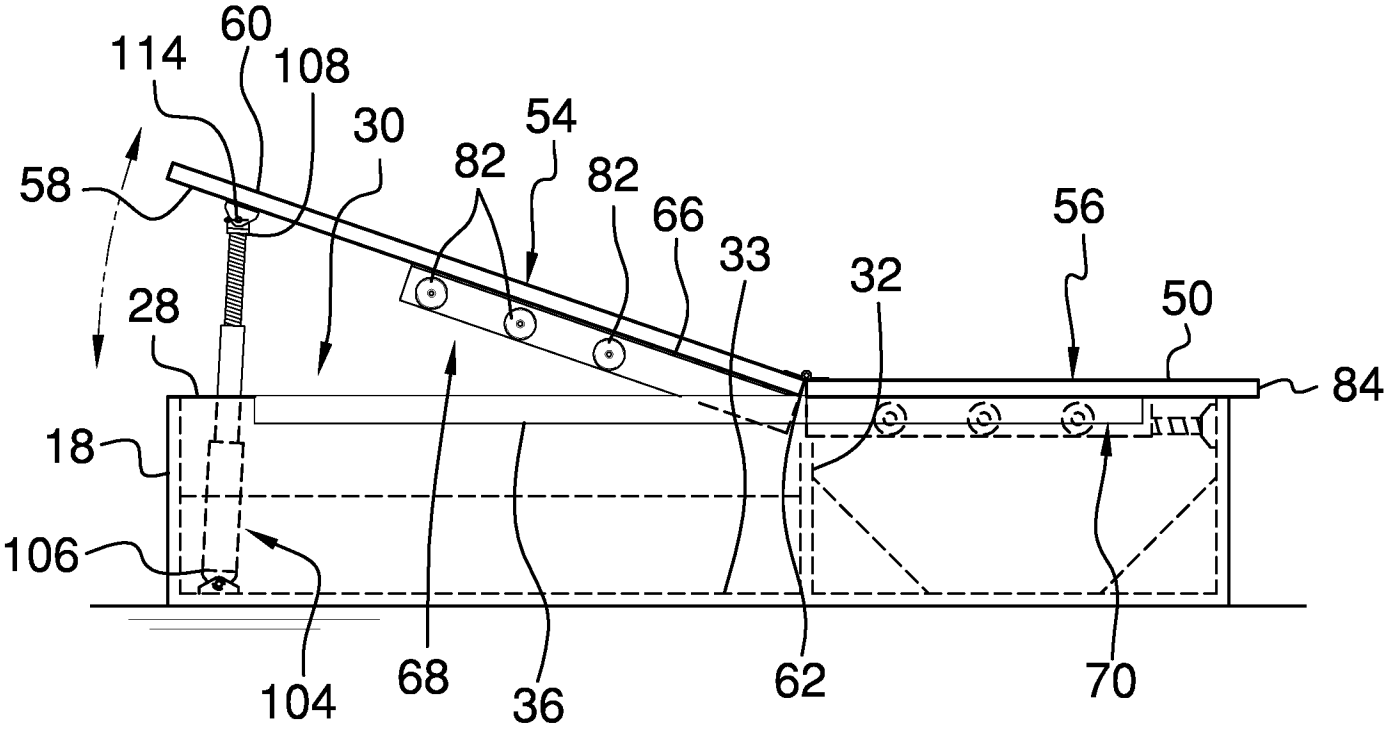
FIG. 7 is a right side phantom view of an embodiment of the disclosure showing a lid being urged into an open position.

With reference now to the drawings, and in particular to FIGS. 1 through 7 thereof, a new bed and frame device embodying the principles and concepts of an embodiment of the disclosure and generally designated by the reference numeral 10 will be described.

As best illustrated in FIGS. 1 through 7, the bed and frame assembly 10 generally comprises a box 12 that is positionable on a horizontal support surface 14. The horizontal support surface 14 may be a floor in a recreational vehicle, such as a camper, or the horizontal support surface 14 may be a floor in the bedroom of a house. The box 12 has a bottom wall 16 and a perimeter wall 18 extending upwardly from the bottom wall 16, and the perimeter wall 18 has a front side 20, a back side 22, a first lateral side 24 and a second lateral side 26. Furthermore, the perimeter wall 18 has a top edge 28 defining an opening 30 into the box 12. The box 12 includes a support 32 that extends upwardly from a top surface 33 of the bottom wall 16. The support 32 is centrally positioned between the first lateral side 24 and the second lateral side 26 of the perimeter wall 18, and the support 32 is positioned closer to the back side 22 than the front side 20 of the perimeter wall 18. Additionally, the support 32 has a distal end 34 with respect to the bottom wall 16.

A pair of tracks 36 is each removably disposed on the box 12 and each of the tracks 36 has a top section 38 that is perpendicularly oriented to a middle section 40. Each of the tracks 36 has an outer section 42 that is perpendicularly oriented to the top section 38 such that the outer section 42 is spaced from the middle section 40. In that way a box space 44 is defined between the outer section 42 and the middle section 40. Each of the tracks 36 has a lower section 46 that is perpendicularly oriented with the middle section 40, and the lower section 46 extends in an opposite direction from the middle section 40 with respect to the top section 38. Each of the tracks 36 is positioned on a respective one of the first lateral side 24 and the second lateral side 26 of the perimeter wall 18 of the box 12 having the perimeter wall 18 extending into the box space 44. The top section 38 of each of the tracks 36 rests on the top edge 28 of the perimeter wall 18 having the middle section 40 of each of the tracks 36 extending downwardly along an inside surface 48 of the perimeter wall 18 such that the lower section 46 is oriented to lie on a horizontal plane. Furthermore, each of the tracks 36 is elongated to extend substantially between the front side 20 and the back side 22 of the perimeter wall 18.

A lid 50 is slidably disposed on the box 12 such that a mattress 52 can be positioned on the lid 50. The mattress 52 may be a sleeping mattress of any conventional size and design, and each of the box 12 and the lid 50 may be constructed with dimensions to accommodate the size of the mattress 52. The lid 50 is positionable in a first position having the lid 50 closing the box 12 to facilitate the mattress 52 to be employed for sleeping. Conversely, the lid 50 is positionable in a second position having the lid 50 being displaced from the box 12 to facilitate the mattress 52 to be more accessible for changing sheets on the mattress 52.

The lid 50 includes a first portion 54 that is hingedly coupled to a second portion 56. The first portion 54 is positionable in an open position having the first portion 54 extending upwardly from the box 12 to access an interior of the box 12. Conversely, the first portion 54 is positionable in a closed position having the first portion 54 resting on the box 12. The lid 50 has a bottom surface 58 and a top surface 60, and the lid 50 has a cut 62 extending through the top surface 60 and the bottom surface 58 to define the first portion 54 and the second portion 56. A hinge 64 is coupled to the top surface 60 of the lid 50 for hingedly attaching the first portion 54 to the second portion 56.

A plurality of roller units 66 is each disposed on the lid 50 and each of the roller units 66 rollably engages a respective one of the tracks 36 to facilitate the lid 50 to be rolled between the first position and the second position. The plurality of roller units 66 includes a pair of first roller units 68 and a pair of second roller units 70. Each of the first roller units 68 is positioned on the first portion 54 of the lid 50 and each of the second roller units 70 is positioned on the second portion 56 of the lid 50. Each of the roller units 66 comprises a bracket 72 which comprises a primary portion 74 that is perpendicularly oriented to a secondary portion 76. The primary portion 74 is coupled to the bottom surface 58 of the lid 50 having the secondary portion 76 extending downwardly from the bottom surface 58. Furthermore, the bracket 72 corresponding to each of the roller units 66 is positioned to extend along a respective one of a first lateral edge 78 and a second lateral edge 80 of the lid 50.

Each of the roller units 66 includes a plurality of rollers 82 that is each rotatably coupled to the secondary portion 76 of the bracket 72. The plurality of rollers 82 is spaced apart from each other and is distributed along a substantial length of the bracket 72. Each of the rollers 82 rests upon the lower section 46 of a respective one of the tracks 36 when the lid 50 is positioned in the closed position thereby facilitating the lid 50 to be rolled between the first position and the second position. A back edge 84 of the lid 50 is positioned adjacent to the back side 22 of the perimeter wall 18 of the box 12 when the lid 50 is in the first position. Conversely, the back edge 84 of the lid 50 is spaced from the back side 22 of the perimeter wall 18 when the lid 50 is in the second position.

A sliding unit 86 is integrated into the box 12 and the sliding unit 86 is in mechanical communication with the lid 50. The sliding unit 86 is actuatable in a closing condition for sliding the lid 50 into the first position. Conversely, the sliding unit 86 is actuatable in an opening condition for sliding the lid 50 into the second position. The sliding unit 86 comprises a screw 88 that has a first end 90, a second end 92 and an outer surface 94 extending between the first end 90 and the second end 92, and the outer surface 94 is threaded. As is most clearly shown in FIGS. 3, 4, 5 and 7, a plurality of gussets 96 may be disposed between the bottom wall 16 of the box 12 and a respective one of the back side 22 of the perimeter wall 18 and the support 32 for enhancing structural integrity of the box 12.

The sliding unit 86 includes a bearing 98 that is coupled to the back side 22 of the perimeter wall 18 of the box 12 having the bearing 98 being positioned inside of the box 12. The first end 90 of the screw 88 rotatably engages the bearing 98. The sliding unit 86 includes a motor 100 that is positioned on the support 32 which extends upwardly from the bottom wall 16 of the box 12. The second end 92 of the screw 88 is rotatably coupled to the motor 100 and the motor 100 is actuatable to rotate in a first direction or a second direction. The screw 88 is rotated in an opening direction when the motor 100 rotates in the first direction and the screw 88 rotates in a closing direction when the motor 100 rotates in the second direction. The motor 100 may comprise two direction electric motor 100 or the like. The sliding unit 86 includes a collar 102 through which the screw 88 extends such that the collar 102 threadably engages the outer surface 94 of the screw 88. The collar 102 is coupled to bottom surface 58 of the lid 50 and the collar 102 is positioned on the second portion 56 of the lid 50.

A jack 104 is pivotally disposed in the box 12 and the jack 104 pivotally engages the first portion 54 of the lid 50. The jack 104 is actuatable into a lowering condition for positioning the first portion 54 in the closed position and the jack 104 is actuatable into a lifting condition for positioning the first portion 54 in the open position. The jack 104 has a lower end 106 and an upper end 108, and the upper end 108 is extendable away from the lower end 106 when the jack 104 is actuated into the lifting condition. Furthermore, the upper end 108 is retractable toward the lower end 106 when the jack 104 is actuated into the lowering condition. The jack 104 may comprise an electrically actuated hydraulic jack, an electric linear actuator or any other type of lifting mechanism that can either lift or lower the lid 50.

A first pivot 110 is coupled to the top surface 60 of the bottom wall 16 of the box 12 and the first pivot 110 is positioned adjacent to the front side 20 of the perimeter wall 18 of the box 12. Furthermore, the lower end 106 of the jack 104 pivotally engages the first pivot 110. A second pivot 112 is coupled to the bottom surface 58 of the lid 50 and the second pivot 112 is positioned on the first portion 54 of the lid 50. The upper end 108 of the jack 104 pivotally engages the second pivot 112, and as is most clearly shown in FIG. 2, a clevis pin 114 may extend through the second pivot 112 to releasably attach the upper end 108 of the jack 104 to the second pivot 112. Each of the motor 100 and the jack 104 may be electrically coupled to a control panel that is conspicuously located to be easily accessible to a user for sliding the lid 50 as well as opening and closing the lid 50.

In use, the motor 100 is actuated to rotate in the first direction to slide the lid 50 into the second position. In this way the mattress 52 is more easily accessible for changing sheets on the mattress 52 or to rotate the mattress 52 on the lid 50. The motor 100 is actuated to rotate in the second direction to slide the lid 50 into the first position thereby positioning the mattress 52 for sleeping. Additionally, the jack 104 can be actuated into the lifting condition, regardless of the positioning of the lid 50, for opening the first portion 54 of the lid 50 to access the interior of the box 12. In this way objects that are stored in the box 12 can be accessed. The jack 104 can be actuated in the lowering condition to close the first portion 54 of the lid 50 at any time.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bed and frame assembly which includes a slidable panel to assist with changing bed sheets or rotating a mattress, said assembly comprising:

a box being positionable on a horizontal support surface;

a pair of tracks, each of said tracks being removably disposed on said box;

a lid being slidably disposed on said box wherein said lid is configured to have a mattress being positioned thereon, said lid being positionable in a first position having said lid closing said box wherein said lid is configured to facilitate said mattress to be employed for sleeping, said lid being positionable in a second position having said lid being displaced from said box wherein said lid is configured to facilitate sheets on the mattress to be changed;

a plurality of roller units, each of said roller units being disposed on said lid, each of said roller units rollably engaging a respective one of said tracks to facilitate said lid to be rolled between said first position and said second position;

a sliding unit being integrated into said box, said sliding unit being in mechanical communication with said lid, said sliding unit being actuatable in a closing condition for sliding said lid into said first position, said sliding unit being actuatable in an opening condition for sliding said lid into said second position;

wherein said lid includes a first portion being hingedly coupled to a second portion, said first portion being positionable in an open position having said first portion extending upwardly from said box to access an interior of said box, said first portion being positionable in a closed position having said first portion resting on said box, said lid having a bottom surface and a top surface, said lid having a cut extending through said top surface and said bottom surface to define said first portion and said second portion;

said plurality of roller units includes a pair of first roller units and a pair of second roller units, each of said first roller units being positioned on said first portion of said lid, each of said second roller units being positioned on said second portion of said lid; and each of said roller units comprises:

a bracket comprising a primary portion being perpendicularly oriented to a secondary portion, said primary portion being coupled to said bottom surface of said lid having said secondary portion extending downwardly from said bottom surface, said bracket corresponding to each of said roller units being positioned to extend along a respective one of a first lateral edge and a second lateral edge of said lid; and a plurality of rollers, each of said rollers being rotatably coupled to said secondary portion of said bracket, said plurality of rollers being spaced apart from each other and being distributed along a substantial length of said bracket, each of said rollers resting upon a lower section of a respective one of said tracks when said lid is positioned in said closed position thereby facilitating said lid to be rolled between said first position and said second position, a back edge of said lid being positioned adjacent to said back side of said perimeter wall of said box when said lid is in said first position, said back edge of said lid being spaced from said back side of said perimeter wall when said lid is in said second position.

2. The assembly according to claim 1, wherein each of said tracks has a top section being perpendicularly oriented to a middle section, each of said tracks having an outer section being perpendicularly oriented to said top section such that said outer section is spaced from said middle section to define a box space between said outer section and said middle section, each of said tracks having a lower section being perpendicularly oriented with said middle section, said lower section extending in an opposite direction from said middle section with respect to said top section.

3. The assembly according to claim 2, wherein:

said box has a bottom wall and a perimeter wall extending upwardly from said bottom wall, said perimeter wall having a front side, a back side, a first lateral side and a second lateral side, said perimeter wall having a top edge defining an opening into said box, said box including a support extending upwardly from a top surface of said bottom wall, said support being centrally positioned between said first lateral side and said second lateral side of said perimeter wall, said support being positioned closer to said back side than said front side of said perimeter wall, said support having a distal end with respect to said bottom wall; and each of said tracks is positioned on a respective one of said first lateral side and said second lateral side of said perimeter wall of said box having said perimeter wall extending into said box space, said top section of each of said tracks resting on said top edge of said perimeter wall having said middle section of each of said tracks extending downwardly along an inside surface of said perimeter wall such that said lower section is oriented to lie on a horizontal plane, each of said tracks being elongated to extend substantially between said front side and said back side of said perimeter wall.

4. A bed and frame assembly which includes a slidable panel to assist with changing bed sheets or rotating a mattress, said assembly comprising:

a box being positionable on a horizontal support surface;

a pair of tracks, each of said tracks being removably disposed on said box;

a lid being slidably disposed on said box wherein said lid is configured to have a mattress being positioned thereon, said lid being positionable in a rust position having said lid closing said box wherein said lid is configured to facilitate said mattress to be employed for sleeping, said lid being positionable in a second position having said lid being displaced from said box wherein said lid is configured to facilitate sheets on the mattress to be changed;

a plurality of roller units, each of said roller units being disposed on said lid, each of said roller units rollably engaging a respective one of said tracks to facilitate said lid to be rolled between said first position and said second position;

a sliding unit being integrated into said box, said sliding unit being in mechanical communication with said lid, said sliding unit being actuatable in a closing condition for sliding said lid into said first position, said sliding unit being actuatable in an opening condition for sliding said lid into said second position;

wherein each of said tracks has a top section being perpendicularly oriented to a middle section, each of said tracks having an outer section being perpendicularly oriented to said top section such that said outer section is spaced from said middle section to define a box space between said outer section and said middle section, each of said tracks having a lower section being perpendicularly oriented with said middle section, said lower section extending in an opposite direction from said middle section with respect to said top section;

wherein said box has a bottom wall and a perimeter wall extending upwardly from said bottom wall, said perimeter wall having a front side, a back side, a first lateral side and a second lateral side, said perimeter wall having a top edge defining an opening into said box, said box including a support extending upwardly from a top surface of said bottom wall, said support being centrally positioned between said first lateral side and said second lateral side of said perimeter wall, said support being positioned closer to said back side than said front side of said perimeter wall, said support having a distal end with respect to said bottom wall;

wherein each of said tracks is positioned on a respective one of said first lateral side and said second lateral side of said perimeter wall of said box having said perimeter wall extending into said box space, said top section of each of said tracks resting on said top edge of said perimeter wall having said middle section of each of said tracks extending downwardly along an inside surface of said perimeter wall such that said lower section is oriented to lie on a horizontal plane, each of said tracks being elongated to extend substantially between said front side and said back side of said perimeter wall;

a screw having a first end, a second end and an outer surface extending between said first end and said second end, said outer surface being threaded;

a bearing being coupled to said back side of said perimeter wall of said box having said bearing being positioned inside of said box, said first end of said screw rotatably engaging said bearing;

a motor being positioned on said support extending upwardly from said bottom wall of said box, said second end of said screw being rotatably coupled to said motor, said motor being actuatable to rotate in a first direction or a second direction, said screw being rotated in an opening direction when said motor rotates in said first direction, said screw rotating in a closing direction when said motor rotates in said second direction; and a collar having said screw extending through said collar such that said collar threadably engages said outer surface of said screw, said collar being coupled to a bottom surface of said lid.

5. The assembly according to claim 1, wherein:

said box has a bottom wall and a perimeter wall extending upwardly from said bottom wall, said perimeter wall having a front side, a back side, a first lateral side and a second lateral side;

said assembly includes a jack being pivotally disposed in said box, said jack pivotally engaging said first portion of said lid, said jack being actuatable into a lowering condition for positioning said first portion in said closed position, said jack being actuatable into a lifting condition for positioning said first portion in said open position, said jack having a lower end and an upper end, said upper end being extendable away from said lower end when said jack is actuated into said lifting condition, said upper end being retractable toward said lower end when said jack is actuated into said lowering condition;

said assembly includes a first pivot being coupled to a top surface of said bottom wall of said box, said first pivot being positioned adjacent to said front side of said perimeter wall of said box, said lower end of said jack pivotally engaging said first pivot; and said assembly includes a second pivot being coupled to said bottom surface of said lid, said second pivot being positioned on said first portion of said lid, said upper end of said jack pivotally engaging said second pivot.

6. A bed and frame assembly which includes a slidable panel to assist with changing bed sheets or rotating a mattress, said assembly comprising:

a box being positionable on a horizontal support surface, said box having a bottom wall and a perimeter wall extending upwardly from said bottom wall, said perimeter wall having a front side, a back side, a first lateral side and a second lateral side, said perimeter wall having a top edge defining an opening into said box, said box including a support extending upwardly from a top surface of said bottom wall, said support being centrally positioned between said first lateral side and said second lateral side of said perimeter wall, said support being positioned closer to said back side than said front side of said perimeter wall, said support having a distal end with respect to said bottom wall;

a pair of tracks, each of said tracks being removably disposed on said box, each of said tracks having a top section being perpendicularly oriented to a middle section, each of said tracks having an outer section being perpendicularly oriented to said top section such that said outer section is spaced from said middle section to define a box space between said outer section and said middle section, each of said tracks having a lower section being perpendicularly oriented with said middle section, said lower section extending in an opposite direction from said middle section with respect to said top section, each of said tracks being positioned on a respective one of said first lateral side and said second lateral side of said perimeter wall of said box having said perimeter wall extending into said box space, said top section of each of said tracks resting on said top edge of said perimeter wall having said middle section of each of said tracks extending downwardly along an inside surface of said perimeter wall such that said lower section is oriented to lie on a horizontal plane, each of said tracks being elongated to extend substantially between said front side and said back side of said perimeter wall;

a lid being slidably disposed on said box wherein said lid is configured to have a mattress being positioned thereon, said lid being positionable in a first position having said lid closing said box wherein said lid is configured to facilitate said mattress to be employed for sleeping, said lid being positionable in a second position having said lid being displaced from said box wherein said lid is configured to facilitate sheets on the mattress to be changed, said lid including a first portion being hingedly coupled to a second portion, said first portion being positionable in an open position having said first portion extending upwardly from said box to access an interior of said box, said first portion being positionable in a closed position having said first portion resting on said box, said lid having a bottom surface and a top surface, said lid having a cut extending through said top surface and said bottom surface to define said first portion and said second portion;

a plurality of roller units, each of said roller units being disposed on said lid, each of said roller units rollably engaging a respective one of said tracks to facilitate said lid to be rolled between said first position and said second position, said plurality of roller units including a pair of first roller units and a pair of second roller units, each of said first roller units being positioned on said first portion of said lid, each of said second roller units being positioned on said second portion of said lid, each of said roller units comprising:

a bracket comprising a primary portion being perpendicularly oriented to a secondary portion, said primary portion being coupled to said bottom surface of said lid having said secondary portion extending downwardly from said bottom surface, said bracket corresponding to each of said roller units being positioned to extend along a respective one of a first lateral edge and a second lateral edge of said lid; and a plurality of rollers, each of said rollers being rotatably coupled to said secondary portion of said bracket, said plurality of rollers being spaced apart from each other and being distributed along a substantial length of said bracket, each of said rollers resting upon said lower section of a respective one of said tracks when said lid is positioned in said closed position thereby facilitating said lid to be rolled between said first position and said second position, a back edge of said lid being positioned adjacent to said back side of said perimeter wall of said box when said lid is in said first position, said back edge of said lid being spaced from said back side of said perimeter wall when said lid is in said second position;

a sliding unit being integrated into said box, said sliding unit being in mechanical communication with said lid, said sliding unit being actuatable in a closing condition for sliding said lid into said first position, said sliding unit being actuatable in an opening condition for sliding said lid into said second position, said sliding unit comprising:

a screw having a first end, a second end and an outer surface extending between said first end and said second end, said outer surface being threaded;

a bearing being coupled to said back side of said perimeter wall of said box having said bearing being positioned inside of said box, said first end of said screw rotatably engaging said bearing;

a motor being positioned on said support extending upwardly from said bottom wall of said box, said second end of said screw being rotatably coupled to said motor, said motor being actuatable to rotate in a first direction or a second direction, said screw being rotated in an opening direction when said motor rotates in said first direction, said screw rotating in a closing direction when said motor rotates in said second direction; and a collar having said screw extending through said collar such that said collar threadably engages said outer surface of said screw, said collar being coupled to bottom surface of said lid, said collar being positioned on said second portion of said lid;

a jack being pivotally disposed in said box, said jack pivotally engaging said first portion of said lid, said jack being actuatable into a lowering condition for positioning said first portion in said closed position, said jack being actuatable into a lifting condition for positioning said first portion in said open position, said jack having a lower end and an upper end, said upper end being extendable away from said lower end when said jack is actuated into said lifting condition, said upper end being retractable toward said lower end when said jack is actuated into said lowering condition;

a first pivot being coupled to said top surface of said bottom wall of said box, said first pivot being positioned adjacent to said front side of said perimeter wall of said box, said lower end of said jack pivotally engaging said first pivot; and a second pivot being coupled to said bottom surface of said lid, said second pivot being positioned on said first portion of said lid, said upper end of said jack pivotally engaging said second pivot.

* * * * *